US005704887A

United States Patent [19]

Slowik et al.

[11] Patent Number: 5,704,887

[45] Date of Patent: Jan. 6, 1998

[54] EASY LOAD UMBILICUS HOLDER FOR A CENTRIFUGE

[75] Inventors: Steven C. Slowik, Wheeling; Michael J. Scola, Roselle; Thomas J. Gillen, Orland Park, all of Ill.

[73] Assignee: Baxter International Inc., Deerfield, Ill.

[21] Appl. No.: 480,488

[22] Filed: Jun. 7, 1995

[51] Int. Cl.[6] ..... B04B 5/02; B04B 7/06

[52] U.S. Cl. ..... 494/12; 494/18; 210/232

[58] Field of Search ..... 494/12, 18, 21, 494/45, 60, 64, 85; 210/232, 380.1, 781, 782, 787; 422/44, 72, 101

[56] References Cited

U.S. PATENT DOCUMENTS 4,109,852 8/1978 Brown et al. .

5,360,542 11/1994 Williamson, IV et al. ..... 494/45 X 5,370,802 12/1994 Brown ..... 210/782

5,514,069 5/1996 Brown et al. ..... 494/18

*Primary Examiner*—Charles E. Cooley

*Attorney, Agent, or Firm*—Daniel D. Ryan; Denise M. Serewicz; Bradford R. L. Price

[57] ABSTRACT

A tube holder secures to the rotating processing chamber of a centrifuge tubing that conveys fluid to or from the chamber. The tube holder is part of a carrier that is connected by a pin to a support on the processing chamber. The support has walls defining an enclosure. The carrier swings about the pin on the support between an opened position free of the enclosure and a closed position captured within the enclosure. In the opened position, the tube holder is exposed for receiving tubing. In the closed position, the tubing is retained within the enclosure in the tube holder. The tube holder allows straightforward attachment and removal of the tubing, always in a prescribed manner and with a single hand. The tube holder securely retains the tubing during use in a closed, protected environment, safeguarding it against inadvertent dislodgement, removal, or damage.

17 Claims, 9 Drawing Sheets

EASY LOAD UMBILICUS HOLDER FOR A CENTRIFUGE

FIELD OF THE INVENTION

The invention relates to centrifugal processing systems and apparatus.

BACKGROUND OF THE INVENTION

Today blood collection organizations routinely separate whole blood by centrifugation into its various therapeutic components, such as red blood cells, platelets, and plasma.

Conventional blood processing systems and methods use durable centrifuge equipment in association with single use, sterile processing chambers, typically made of plastic. The centrifuge equipment introduces whole blood into these chambers while rotating them to create a centrifugal field. Some conventional centrifuges employ an umbilicus to establish sealless fluid-flow connection between rotating and stationary components.

Conventional centrifuges often do not permit easy access to the areas were disposable systems reside during use. As a result, loading and unloading of the disposables, including the umbilicus, can be time consuming and tedious.

SUMMARY OF THE INVENTION

The invention provides a holder for securing to the rotating processing chamber of a centrifuge tubing that conveys fluid to or from the chamber. The holder is part of a carrier that is connected by a pin to a support on the processing chamber. The support has walls defining an enclosure. The carrier swings about the pin on the support between an opened position free of the enclosure and a closed position captured within the enclosure. In the opened position, the tube holder is exposed for receiving tubing. In the closed position, the tubing is retained within the enclosure in the tube holder.

In a preferred embodiment, a latch is provided for releasably securing the carrier in the closed position. Also in a preferred embodiment, the tube holder includes a cavity having a shape that mates with a support block carried by tubing received in the cavity.

In a preferred embodiment, the processing chamber and the support comprise an integrally molded unit.

The tube holder that embodies the features of the invention is ideally suited for holding a multiple lumen umbilicus that communicates with the processing chamber. The tube holder allows straightforward attachment and removal of the umbilicus, always in a prescribed manner and with a single hand. The holder that embodies the features of the invention securely retains the umbilicus during use in a closed, protected environment, safeguarding it against inadvertent dislodgement, removal, or damage.

Other features and advantages of the inventions are set forth in the following Description and Drawings, as well as in the appended claims.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1:
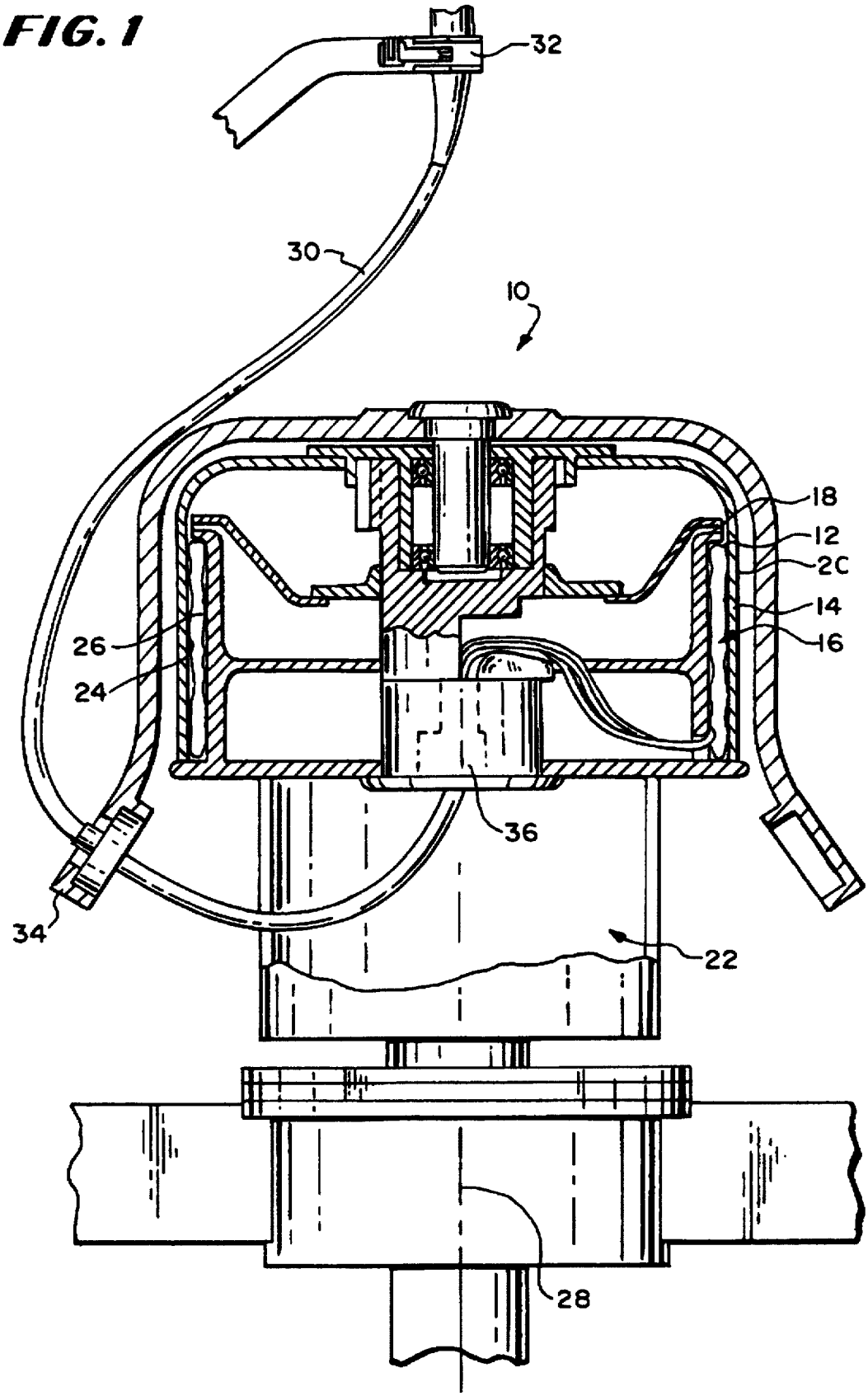
FIG. 1 is a side section view of a blood centrifuge having bowl and spool elements and a lower umbilicus holder that embodies features of the invention.

FIG. 1 shows a blood centrifuge 10 having a blood processing chamber 12. The boundaries of the chamber 12 are formed by a flexible processing container 14 carried within an annular gap 16 between a rotating spool element 18 and bowl element 20. In the illustrated and preferred embodiment (see FIGS. 4 and 5), the processing container 14 takes the form of an elongated tube, which is wrapped about the spool element 18 before use.

Further details of this centrifuge construction are set forth in U.S. Pat. No. 5,370,802, entitled "Enhanced Yield Platelet Systems and Methods," which is incorporated herein by reference.

Figures 2A, 2B:
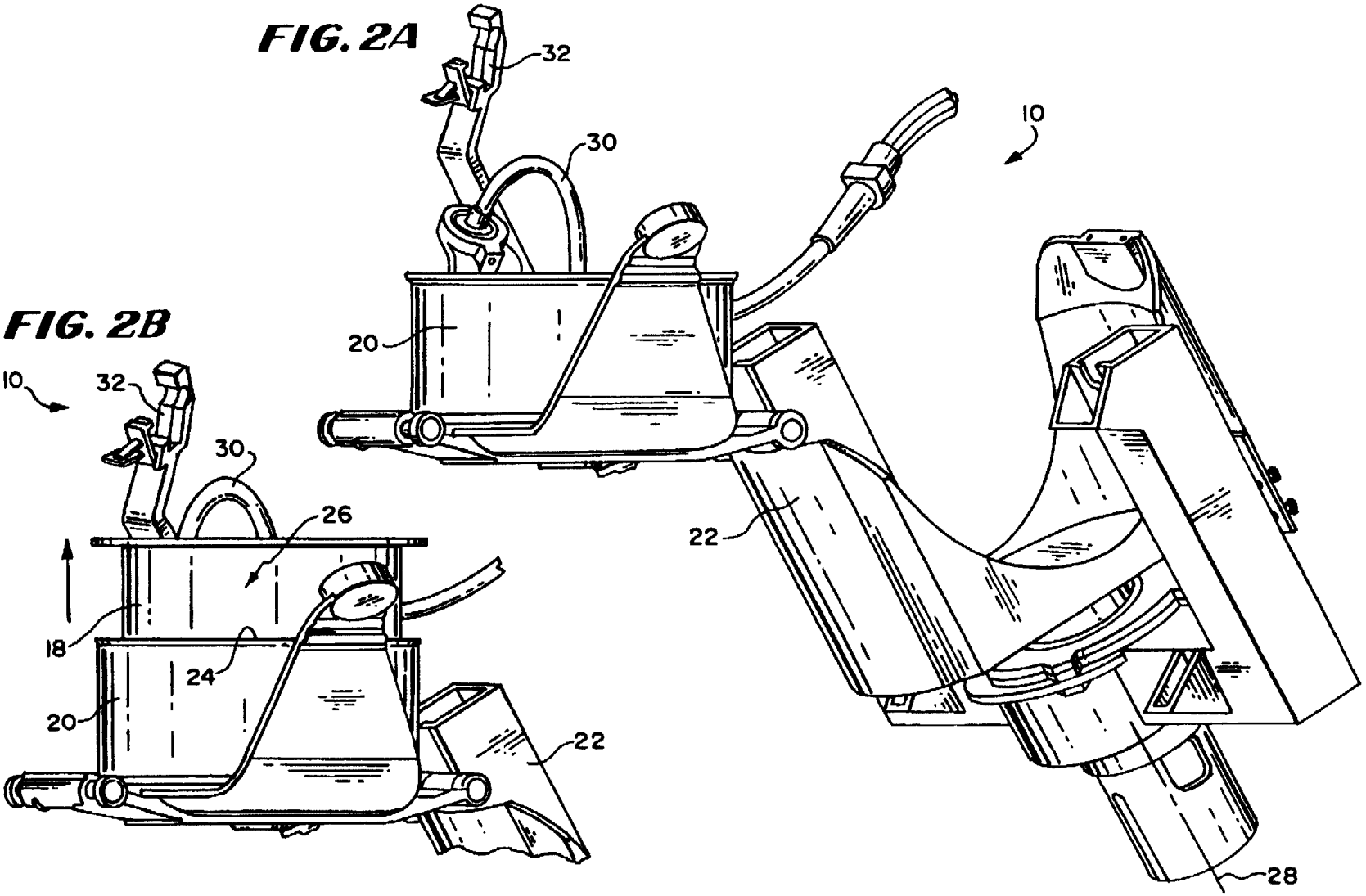
FIG. 2A is a perspective view of centrifuge shown in FIG. 1, with the bowl and spool elements pivoted into their access position.
FIG. 2B is a perspective view of the bowl and spool elements in their mutually separation condition to allow securing the processing container shown in FIG. 4 about the spool element.
Figure 3:
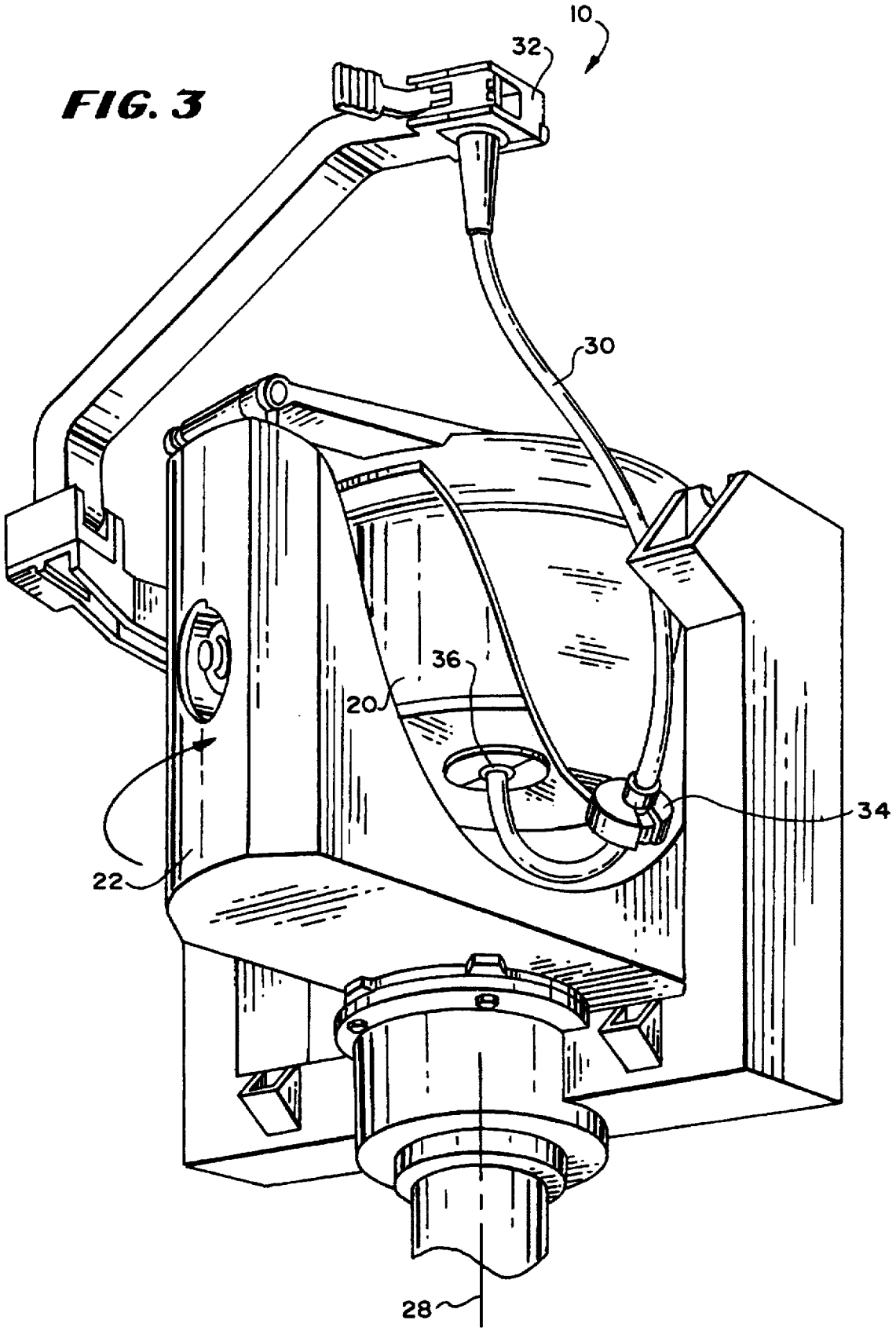
FIG. 3 is a perspective view of centrifuge shown in FIG. 1, with the bowl and spool elements pivoted into their operational position.

The bowl and spool elements 18 and 20 are pivoted on a yoke 22 between an upright position for loading and unloading of the container 14, as FIGS. 2A/2B show, and a suspended position for operation, as FIGS. 1 and 3 show.

Figure 4:
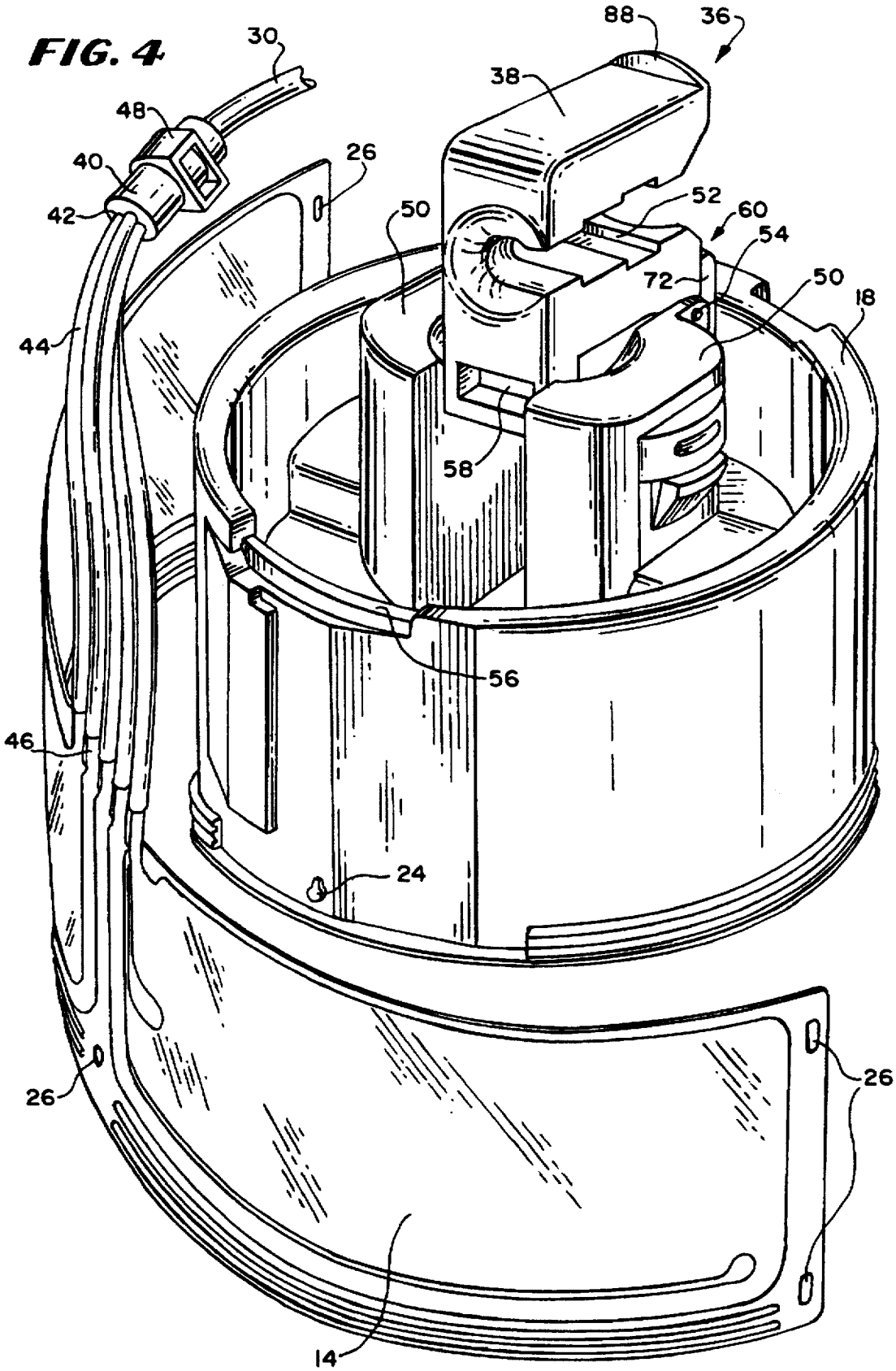
FIG. 4 a perspective view of the spool element (with the bowl element not shown to simplify the illustration) with the associated processing container and umbilicus ready for securement to it for use.
Figure 5:
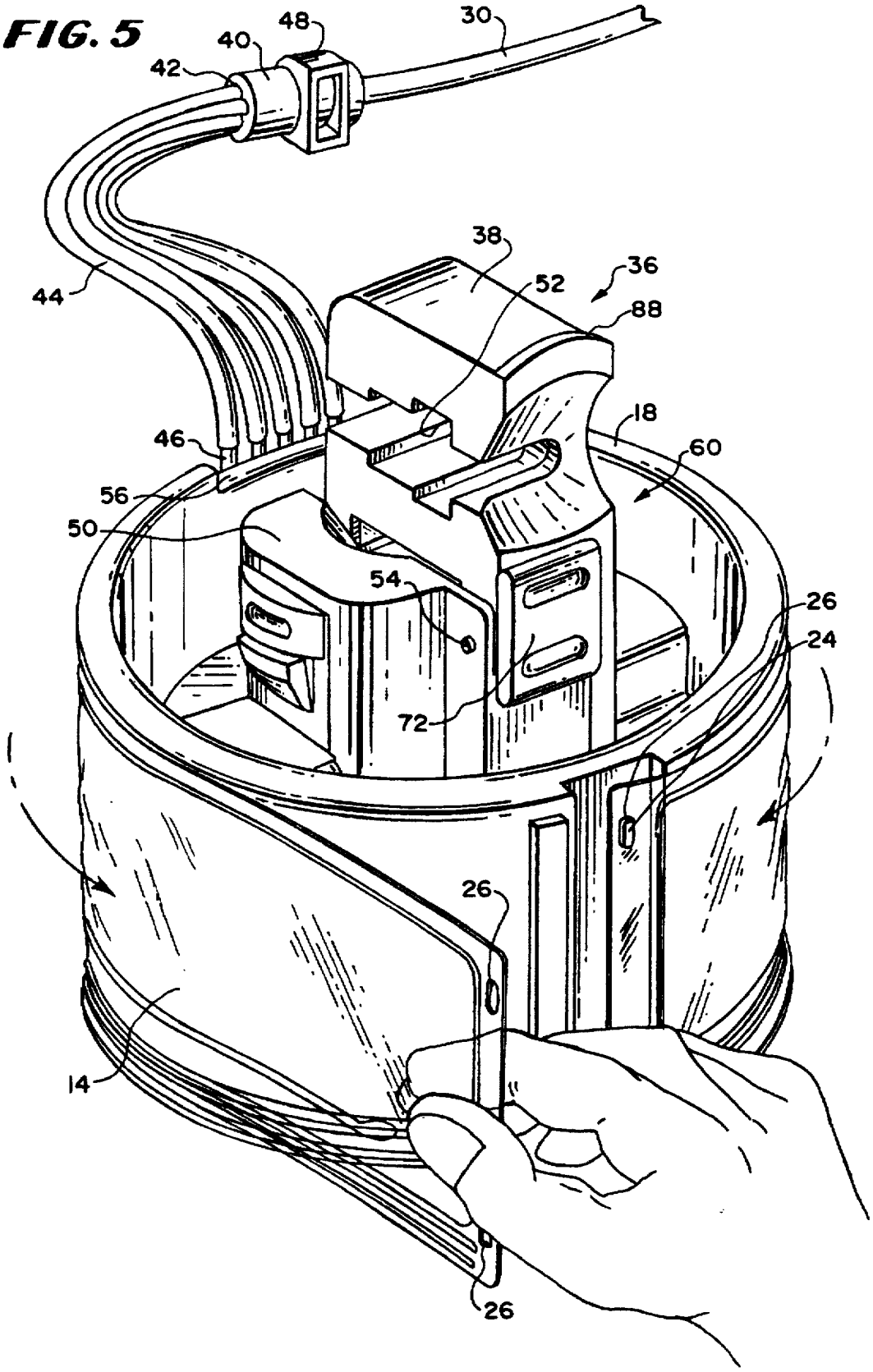
FIG. 5 is a perspective view of the spool element shown in FIG. 4 with the processing container almost wrapped about the spool element, and the umbilicus holder in its load position ready to receive the lower umbilicus support block.

When upright (see FIG. 2A), the bowl and spool elements 18 and 20 are presented for access by the user. A mechanism (not shown) permits the spool and bowl elements 18 and 20 to assume a mutually separated position, as FIG. 2B shows. In this position, the spool element 18 is at least partially out of the interior area of the bowl element 20 to expose the exterior spool surface for access. When exposed, the user can wrap the container 14 about the spool element 18, as FIGS. 4 and 5 show (for simplicity of illustration, FIGS. 4 and 5 do not show the bowl element 20). Pins 24 on the spool element 18 (see FIGS. 4 and 5) engage cutouts 26 on the container 14 to secure the container 14 on the spool element 18.

The mechanism also permits the spool and bowl elements 18 and 20 to assume a mutually cooperating position, as FIG. 2A shows. In this position, the spool element 18 and the secured container 14 are enclosed within the interior area of the bowl element 20.

Further details of the mechanism for causing relative movement of the spool and bowl elements 18 and 20 as just described are disclosed in U.S. Pat. No. 5,360,542 entitled "Centrifuge With Separable Bowl and Spool Elements Providing Access to the Separation Chamber," which is incorporated herein by reference.

When closed, the spool and bowl elements 18 and 20 can be pivoted into a suspended position, as FIGS. 1 and 3 show. When suspended, the bowl and spool elements 18 and 20 are in position for operation.

In operation, the centrifuge 10 rotates the suspended bowl and spool elements 18 and 20, with attached container 14, about an axis 28, creating a centrifugal field within the processing chamber 12.

An umbilicus 30 (see FIG. 1) establishes communication between the interior of the processing container 14 within the centrifugal field and pumps and other stationary components located outside the centrifugal field. The umbilicus is preferably made of a high modulus Hytrel® Plastic Material (DuPont), like Hytrel® 4056 Material. As the spool and bowl elements 18 and 20 rotate about the axis 28, whole blood and separated blood components are conveyed through lumens in the umbilicus 30 into and out of the container 14.

As FIGS. 1 and 3 show, a non-rotating (zero omega) holder 32 holds the upper portion of the umbilicus 30 in a non-rotating position above the suspended spool and bowl elements 18 and 20. A holder 34 on the yoke 22 rotates the mid-portion of the umbilicus 30 at a first (one omega) speed about the suspended spool and bowl elements 18 and 20. Another holder 36 rotates the lower end of the umbilicus 30 at a second speed twice the one omega speed (the two omega speed), at which the suspended spool and bowl elements 18 and 20 also rotate. This known relative rotation of the umbilicus 30 keeps it untwisted, in this way avoiding the need for rotating seals.

FIGS. 4 to 10 show further details of the construction and operation of the lower umbilicus holder 36. According to the invention, the holder 36 simplifies the loading and unloading of the umbilicus 30 by the operator before and after use. At the same time, the holder 36 provides a secure and protected enclosure for retaining the umbilicus 30 during use.

The holder 36 includes a carrier 38 for receiving a support block 40 on the umbilicus 30.

The support block 40 is preferably made from a softer and more flexible Hytrel® Plastic Material; for example, Hytrel® 8122 Material. The support block 40 is injection over-molded about the umbilicus 30.

The support block 40 includes formed lumens 42 which communicate with the lumens in the umbilicus 30. Medical grade polyvinyl tubes 44 are secured by solvent bonding to the support block lumens 42. The tubes 44 are secured at their opposite ends to ports 46 communicating with the container 14.

The support block 40 also preferably includes an integral molded flange 48. The flange 48 has a predetermined shape, which can vary. In the illustrated embodiment, the flange 48 is generally D-shaped. The carrier 38 includes a preformed cavity 52 shaped to mate with the support block 40 and flange 48 on the umbilicus 30.

The carrier 38 is pivotally mounted within the supports 50. Preferably, the supports 50 and spool element 18 form an integrally molded assembly, made from a durable plastic material like polyvinyl chloride. The carrier 38 is also separately molded from this or another plastic material. The carrier 38 is attached by a pivot pin 54 extending between the supports 50. The carrier 38 swings between two positions about the pivot pin 54.

Figure 6:
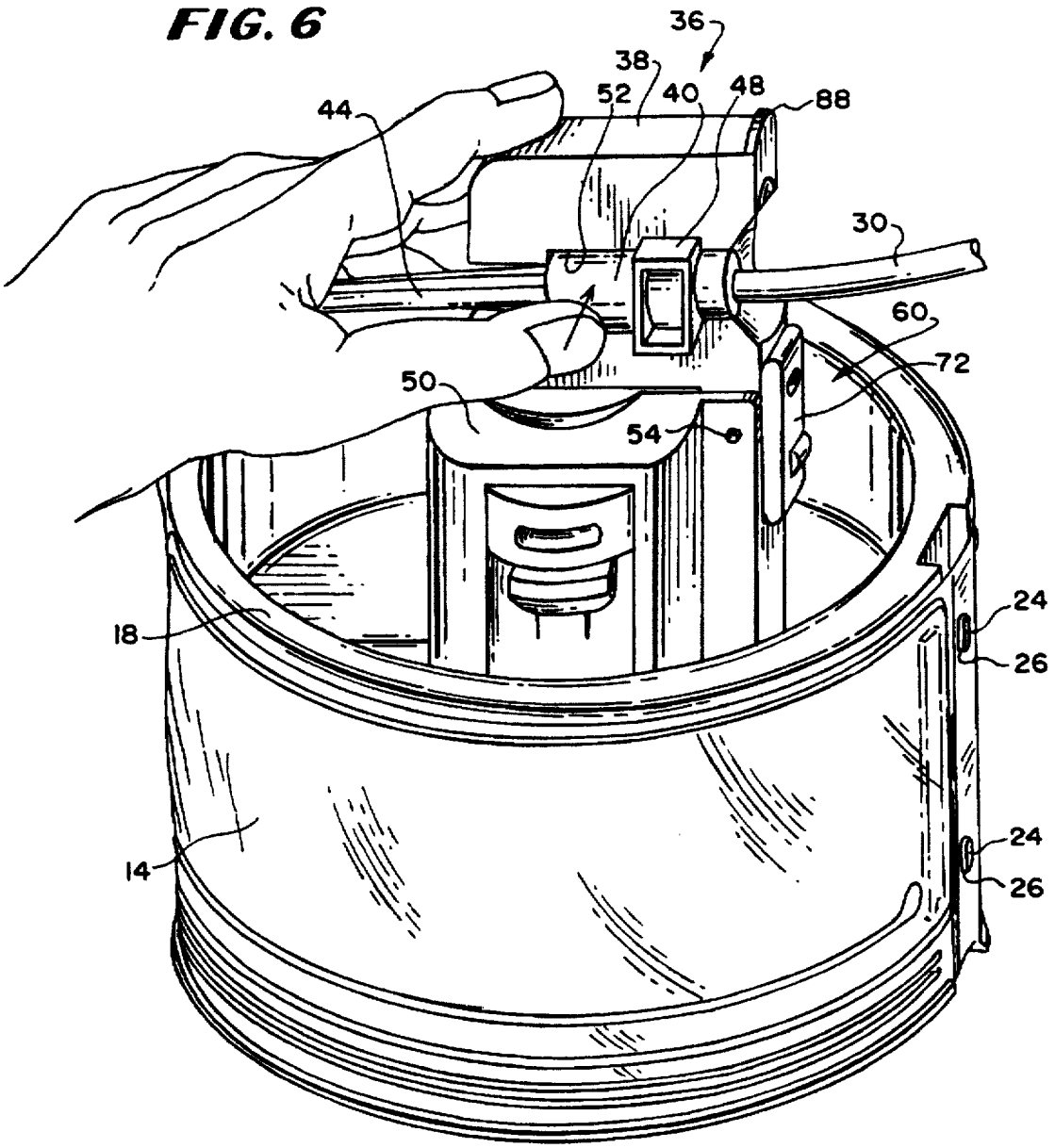
FIG. 6 is a perspective view of the spool element, with the processing container secured to it, and with the operator pressing the lower umbilicus support block into the opened umbilicus holder.

In a first or opened position (shown in FIGS. 4 to 6 and 9), the carrier cavity 52 is exposed outside the supports 50 in a generally horizontal position for receiving the support block 40 and flange 48 in a single, predetermined way. More particularly, with the container 14 properly secured to the spool element 18 (see FIG. 6), the support block 40 and flange 48 fit within the carrier cavity 52 with the tubing 44 facing towards the container ports 46. As FIG. 6 shows, the operator is able to conveniently slide the support block 40 and flange 48 easily into the carrier cavity 52 with one hand.

Figure 7:
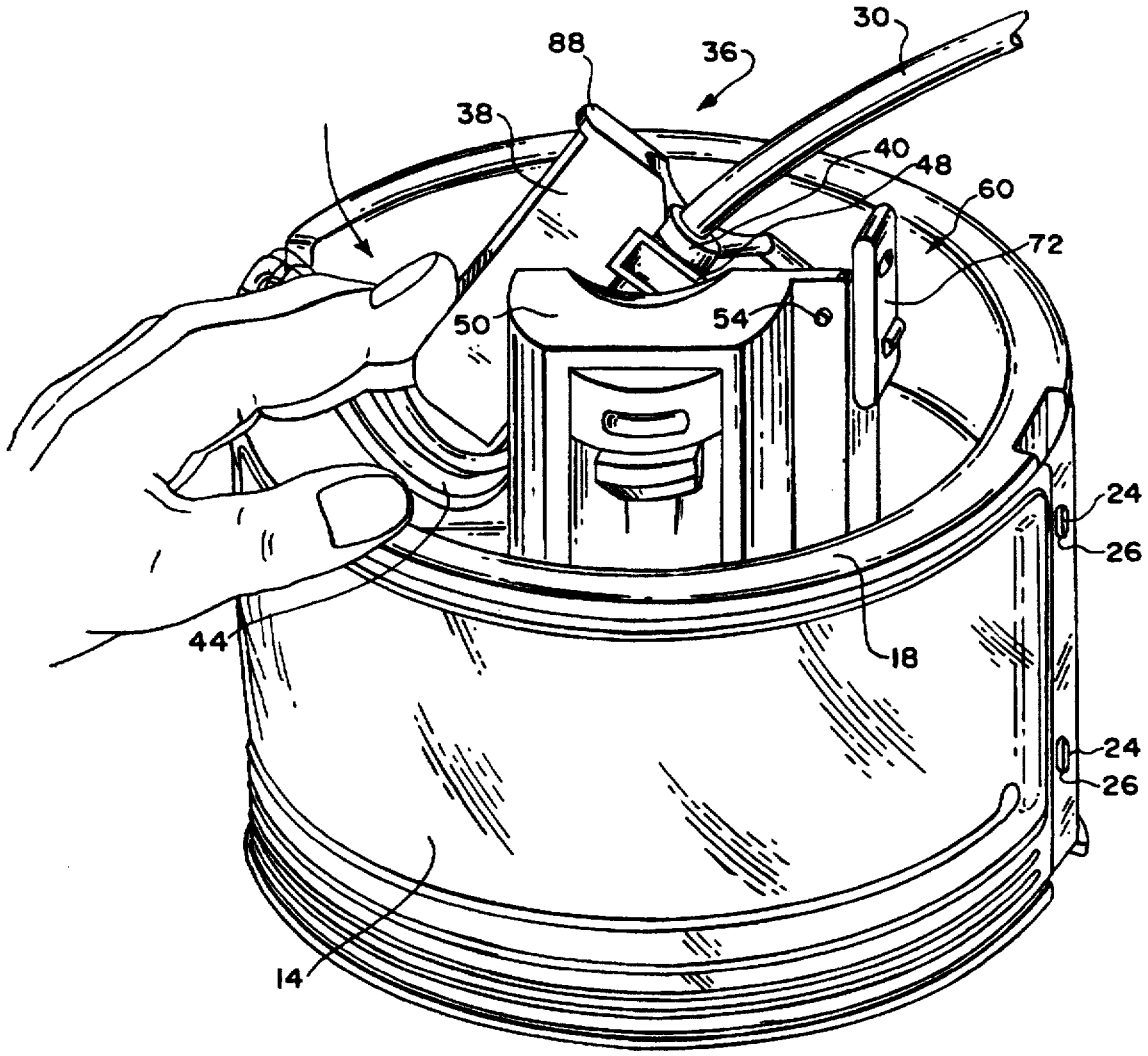
FIG. 7 is a perspective view of the spool element, with the processing container secured to it, and with the operator moving the umbilicus holder, now carrying the lower umbilicus support block, into the closed position for use.
Figure 8:
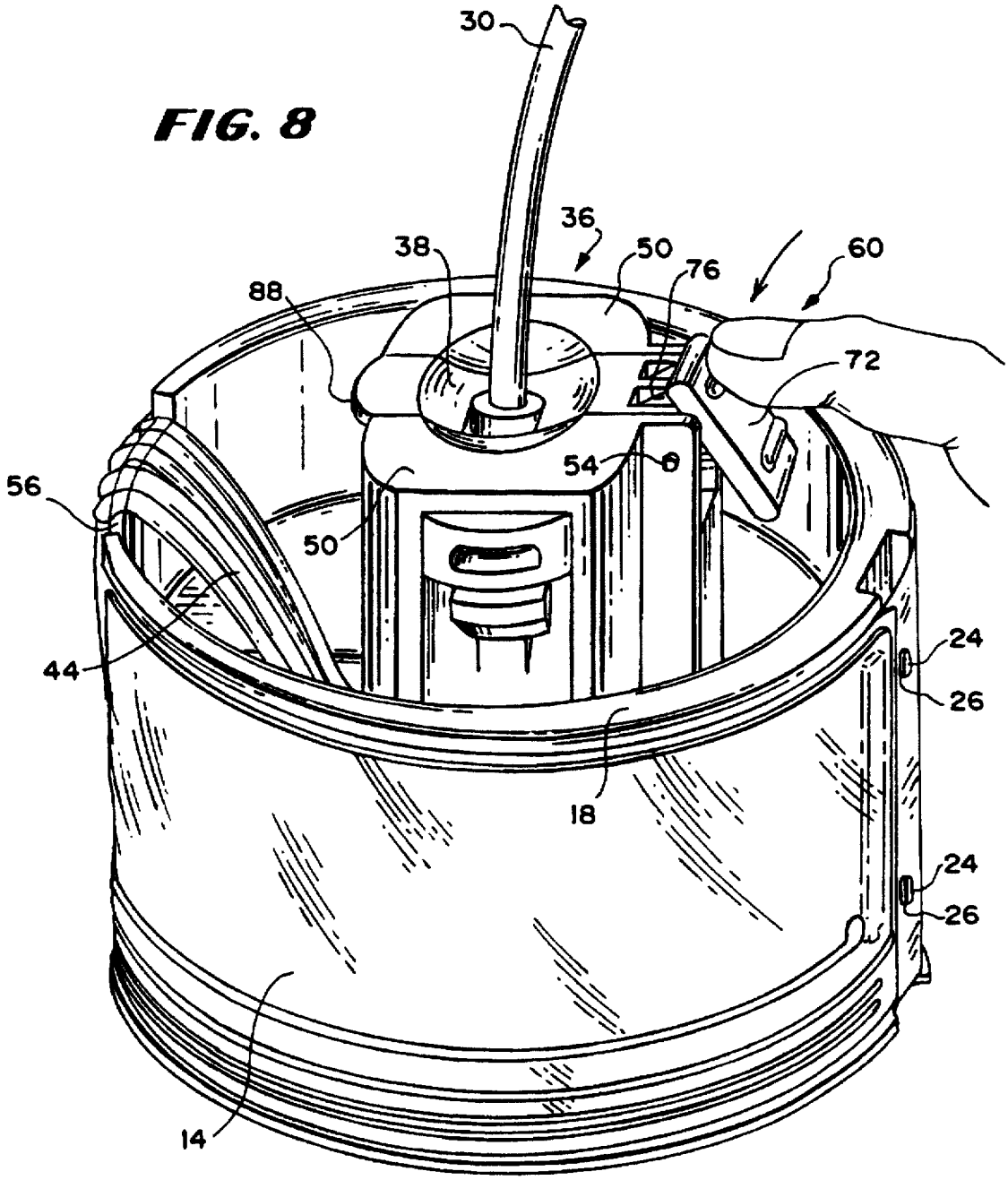
FIG. 8 is a perspective view of the spool element, with the processing container secured to it, and with the operator locking the umbilicus holder into its closed position.

With one hand (see FIG. 7), the operator is also able pivot the carrier 38 and the support block 40 and flange 48 it carries into a second or closed position (see FIG. 8). In this position, the carrier cavity 52 and support block 40 and flange 48 are located in a generally vertical position, enclosed by the supports 50. The tubing 44 leading to the container 14 is placed into slight tension. The tubing 44 extends in this condition from the carrier cavity 52 (which now points towards the bottom of the spool element 18) upward through the open interior of the spool element 18 to an edge 56 against which the container ports 46 rest.

The holder 36 further includes a latch mechanism 60, which releasably locks the carrier 38 in its second or closed position. The details of construction for the latch mechanism 60 can vary.

In the illustrated and preferred embodiment (still referring to FIGS. 9 and 10), the latch mechanism 60 includes a latch bar 62 carried for movement in a channel 64 in the rear of one of the supports 50. The latch bar 62 moves in the channel 64 in a path generally perpendicular to the axis of the pivot pin 54.

The latch bar 62 includes at one end a latch finger 66. The latch finger 66 moves as the latch bar 62 moves into and out of a latch slot 68 located at the end of the channel 64. A spring 70 normally biases the latch bar 62 to a position holding the latch finger 66 free of the latch slot 68 (as FIG. 9 shows).

The carrier 38 includes a keyway 58 (see also FIG. 4) that fits into the latch slot 68 when the carrier 38 is in its second or closed position.

A latch tab 72 with attached cam member 74 pivots about the pin 54. The cam member 74 is located within a slot 76 on the carrier 38 (see FIG. 8), so the cam member 74 can be pivoted about the pin 54 independent of the carrier 38 when the carrier 38 is in its closed position, as FIG. 8 shows. With the carrier 38 in its closed position, the latch tab 72 can be moved by finger pressure between an upward unlatched position (see FIG. 7) and a downward latched position (see FIG. 10). Movement of the tab 72 pivots the cam member 74.

Figure 9:
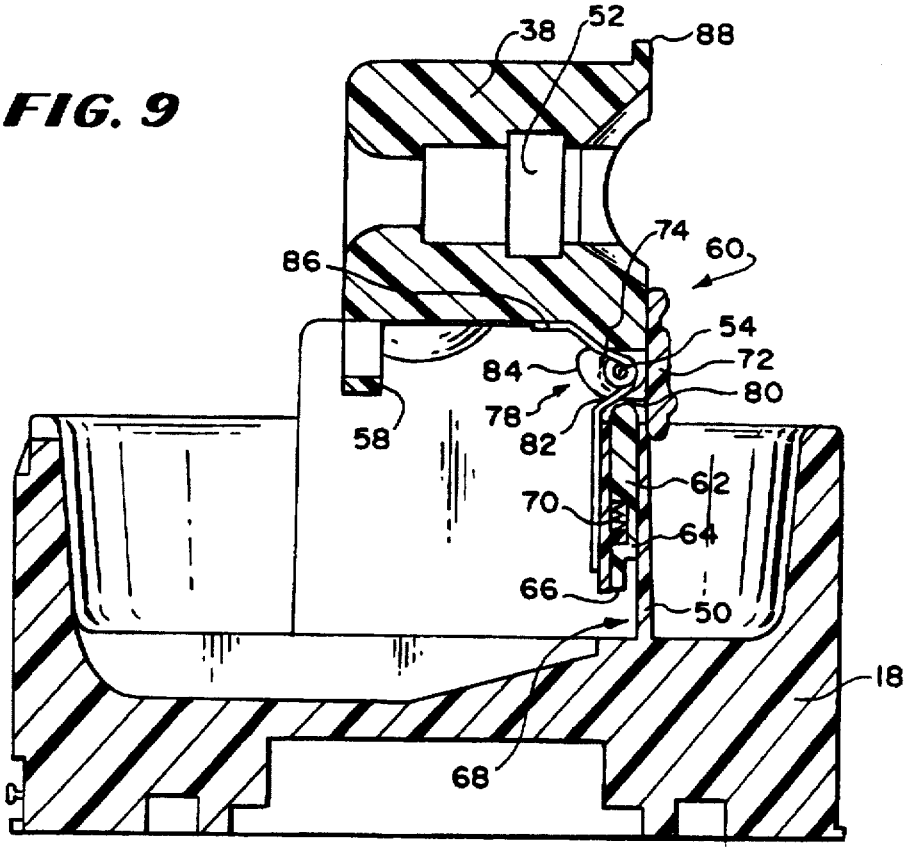
FIG. 9 is a side section view of the umbilicus holder shown in FIG. 4 in its opened and unlatched position.
Figure 10:
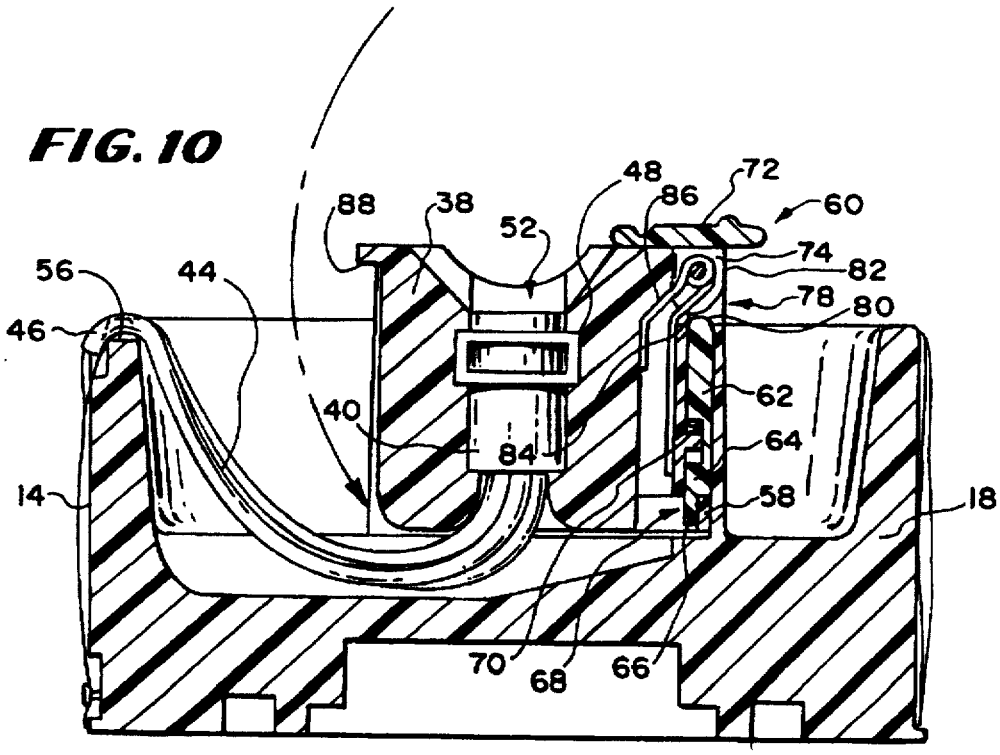
FIG. 10 is a side section view of the umbilicus holder shown in FIG. 8 in its closed and latched position.

As FIGS. 9 and 10 show, the cam member 74 has an eccentric surface 78 that rests against the latch bar 62 at the end 80 opposite to the latch finger 66. The spring 70 continuously urges the latch bar end 80 against the surface 78.

The eccentric surface 78 has a first, generally flat region 82 that is presented to latch bar end 80 when the latch tab 72 is disposed in its unlatched position. When contacting the flat cam region 82, the latch bar 62 occupies its normally biased position holding the latch finger 66 free of the latch slot 68.

The eccentric surface 78 has a second, generally curved region 84 spaced radially farther from the pin 54 than the flat region 82. When the latch tab 72 is moved from its unlatched towards its latched position, the curved region 84 is progressively presented to the latch bar end 80. The curved region 84 urges the latch bar 62 against the biasing force of the spring 70 to advance the latch finger 66 into the latch slot 68 (see FIG. 10). The latch finger 66 also registers with the carrier keyway 58, locking the carrier 38 in its closed position. Subsequent movement of the latch tab 72 toward its unlatched position progressively presents the flat cam region 82 to the latch end 80, allowing the spring-assisted return of the latch bar 62 to its normally biased position. This frees the latch finger 66 from the latch slot 68 and carrier keyway 58. The carrier 38 is free to be moved by the operator back to its open position for removal of the umbilicus support block 40 and flange 48. A lip 88 is provided on the carrier 38 to assist in flipping-up the unlatched carrier 38. In the illustrated and preferred embodiment, a spring 86 is also provided (see FIGS. 9 and 10) to further assist movement of the carrier 38, when unlatched, from its closed position toward its opened position.

In using the holder 36 as just described, the operator wraps the container 14 about the spool element 18. At this point (see FIGS. 4 and 5), the carrier 38 is in its opened position awaiting loading of the umbilicus support block 40 and flange 48. The latch tab 72 is likewise located in its unlatched position.

After securing the container 14 to the spool element 18, the operator then fits the support block 40 and flange 48 into the open carrier cavity 52 (see FIG. 6). The operator closes the carrier 38, as FIG. 7 shows, and then presses the latch tab 72 into its latched position, as FIG. 8 shows.

The operator reverses these steps in removing the umbilicus block 40 from the carrier 38.

The holder 38 as just described provides straightforward attachment and removal of the umbilicus block 40 and flange 48, always in the prescribed manner and with a single hand. The holder 38 securely retains the umbilicus block 40 and flange 48 during use in a closed, protected environment, safeguarding it against inadvertent dislodgement, removal, or damage.

Various features of the inventions are set forth in the following claims.

We claim:

1. A processing element for a centrifuge including a chamber for receiving fluids subject to a centrifugal field, a carrier on the element defining a tube holder to receive tubing that, in use, conveys fluids to or from the chamber, a support on the processing element having walls defining an enclosure, and a pin connecting the carrier to the support, the carrier swinging about the pin on the support between an opened position, in which the tube holder is swung free of the enclosure to open access to the tube holder for receiving the tubing, and a closed position, in which the tube holder is swung into the enclosure to close access to the tube holder and retain the tubing in the tube holder during processing.

2. A processing element according to claim 1 and further including a latch for releasably securing the carrier in the closed position.

3. A processing element according to claim 1 wherein the tube holder includes a cavity having a shape that mates with a support block carried by the tubing received in the tube holder.

4. A processing element according to claim 1 wherein the processing element and the support comprise an integrally molded unit.

5. A centrifuge comprising a processing element mounted for rotation including a chamber for receiving fluids subject to a centrifugal field, an umbilicus for conveying fluid to or from the chamber, a carrier on the element defining a holder to receive a part of the umbilicus, a support on the processing element having walls defining an enclosure, and a pin connecting the carrier to the support, the carrier swinging about the pin on the support between an opened position, in which the holder is swung free of the enclosure to open access to the holder for receiving the part of the umbilicus, and a closed position, in which the holder is swung into the enclosure to close access to the holder and retain the part of the umbilicus in the holder during rotation of the processing element.

6. A centrifuge according to claim 5 and further including a latch for releasably securing the carrier in the closed position.

7. A centrifuge according to claim 5 wherein the part of the umbilicus received by the holder includes a support block, and wherein the holder includes a cavity having a prescribed shape to mate with the support block.

8. A centrifuge according to claim 5 wherein the processing element and the support comprise an integrally molded unit.

9. A centrifuge comprising a yoke element rotatable about a rotational axis, a processing chamber mounted for rotation about a second axis aligned with the rotational axis, an umbilicus that conveys fluid to or from the processing chamber, the umbilicus having a proximal end, a distal end, and a middle region between the proximal and distal ends, a first support block in the proximal end, a second support block in the distal end, and a third support block in the middle region spaced from the first and second support blocks, a first holder to hold the first support block stationary during rotation of the yoke element at a location above the yoke element in alignment with the rotational axis, a second holder on the yoke element to hold the third support block for rotation about the middle umbilicus region during rotation of the yoke element, and a third holder on the processing chamber to hold the second support block for rotation about the second axis during rotation of the yoke element, the third holder comprising a carrier on the processing chamber defining a cavity to receive the second support block, a support on the processing chamber having walls defining an enclosure, and a pin connecting the carrier to the support, the carrier swinging about the pin on the support between an opened position, in which the cavity is swung free of the enclosure to open access to the cavity for receiving the second support block, and a closed position, in which the cavity is swung into the enclosure to close access to the cavity and retain the second support block in the cavity during rotation of the processing chamber.

10. A centrifuge according to claim 9 and further including a motor to rotate the yoke element and thereby impart rotation to the processing chamber as the umbilicus rolls one rotation about its axis for each revolution of the yoke element, the rotation imparted to the processing chamber being twice the rate of rotation of the yoke element to thereby keep the umbilicus untwisted.

11. A centrifuge according to claim 9 or 10 and further including a latch for releasably securing the carrier in the closed position.

12. A centrifuge according to claim 9 or 10 wherein the second support block has a shape, and wherein the cavity is configured to mate with the shape of the second support block.

13. A centrifuge according to claim 9 or 10 wherein the processing element and the support comprise an integrally molded unit.

14. In a centrifugal processing chamber comprising a bowl element having an interior wall peripherally defining an interior area, a spool element having an exterior surface, and a mechanism joining the spool and bowl elements for movement between a mutually cooperating position, in which the spool element is enclosed within the interior area of the bowl to define a processing chamber between the interior bowl wall and the exterior spool surface, and a mutually separated position, in which the spool element is at least partially out of the interior area of the bowl element to expose the exterior spool surface for mounting a flexible processing container having preattached tubing, the improvement comprising a carrier on the bowl element defining a tube holder to receive the tubing, a support on the bowl element having walls defining an enclosure, and a pin connecting the carrier to the support, the carrier swinging about the pin on the support between an opened position, in which the tube holder is swung free of the enclosure to open access to the tube holder for receiving the tubing, and a closed position, in which the tube holder is swung into the enclosure to close access to the tube holder and retain the tubing in the tube holder during rotation of the processing chamber.

15. A centrifuge according to claim 14 and further including a latch for releasably securing the carrier in the closed position.

16. A centrifuge according to claim 14 wherein the tubing includes a support block having a shape, and wherein the tube holder includes a cavity that is configured to mate with the shape of the support block.

17. A centrifuge according to claim 14 wherein the bowl element and the support comprise an integrally molded unit.

* * * * *